US009776409B2

(12) United States Patent
Dooley et al.

(10) Patent No.: US 9,776,409 B2
(45) Date of Patent: Oct. 3, 2017

(54) FLUIDIC EJECTION DEVICE WITH LAYERS HAVING DIFFERENT LIGHT SENSITIVITIES

(71) Applicant: HEWLETT-PACKARD DEVELOPMENT COMPANY, L.P., Houston, TX (US)

(72) Inventors: Kevin Dooley, Blessington County Wicklow (IE); John Larkin, Leixlip (IE); Liam Cheevers, Leixlip (IE); Kenneth Hickey, Dublin (IE); Graeme Scott, Maynooth (IE)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/305,026

(22) PCT Filed: Apr. 24, 2014

(86) PCT No.: PCT/US2014/035308

§ 371 (c)(1),
(2) Date: Oct. 18, 2016

(87) PCT Pub. No.: WO2015/163888

PCT Pub. Date: Oct. 29, 2015

(65) Prior Publication Data

US 2017/0151781 A1 Jun. 1, 2017

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1631* (2013.01)

(58) Field of Classification Search
CPC ..... B41J 2/162; B41J 2/1631; B41J 2/1433
See application file for complete search history.

(56) References Cited

U.S. PATENT DOCUMENTS 6,158,847 A * 12/2000 Usui ..... B41J 2/14233 347/70
6,179,978 B1 * 1/2001 Hirsh ..... B41J 2/162 204/281

(Continued)

FOREIGN PATENT DOCUMENTS

| | | |
|---|---|---|
| EP | 1489460 | 12/2004 |
| JP | 2012171122 A | 9/2012 |
| JP | 2013154571 A | 8/2013 |

OTHER PUBLICATIONS

Tseng et al.; A Novel Fabrication Method of Embedded Micro Channels Employing Simple UV Dosage Control and Antireflection Coating; IEEE, 2002.

*Primary Examiner* — Lamson Nguyen
(74) *Attorney, Agent, or Firm* — HP Inc.-Patent Department

(57) ABSTRACT

A method for forming a fluidic ejection device is described. The method includes depositing a first layer on a silicon wafer, the first layer including a first photoresist, and exposing, at a first energy level, a portion of the first photoresist. The method also includes depositing a second layer on the first layer, the second layer including a second photoresist that is more sensitive to light than the first photoresist, and exposing, at a second energy level, a portion of the second photoresist. The second energy level is less than the first energy level. The method also includes developing unexposed portions of the first photoresist and the second photoresist to form an enclosed firing chamber and a nozzle.

15 Claims, 5 Drawing Sheets

(56) References Cited

U.S. PATENT DOCUMENTS

| | | | | |
|---|---|---|---|---|
| 6,257,700 | B1 * | 7/2001 | Aihara | B41J 2/14233 347/44 |
| 6,419,346 | B1 | 7/2002 | Nikkel | |
| 7,029,099 | B2 | 4/2006 | Lebens et al. | |
| 7,238,464 | B2 | 7/2007 | Fang | |
| 7,354,131 | B2 | 4/2008 | Patil | |
| 7,866,793 | B2 | 1/2011 | Silverbrook et al. | |
| 8,652,767 | B2 | 2/2014 | Watanabe et al. | |
| 2002/0071006 | A1 | 6/2002 | Chen et al. | |
| 2005/0130075 | A1 | 6/2005 | Shaarawi et al. | |
| 2006/0134555 | A1 | 6/2006 | Park et al. | |
| 2008/0122895 | A1 | 5/2008 | Hart et al. | |
| 2009/0017400 | A1 | 1/2009 | Tarutani et al. | |
| 2009/0252923 | A1 | 10/2009 | Ciampini et al. | |

* cited by examiner

FLUIDIC EJECTION DEVICE WITH LAYERS HAVING DIFFERENT LIGHT SENSITIVITIES

BACKGROUND

Printers are devices that deposit ink on a print medium. A printer may include a printhead that includes an ink reservoir. The ink is expelled from the printhead onto a print medium.

BRIEF DESCRIPTION OF THE DRAWINGS

The accompanying drawings illustrate various examples of the principles described herein and are a part of the specification. The illustrated examples do not limit the scope of the claims.

Throughout the drawings, identical reference numbers designate similar, but not necessarily identical, elements.

DETAILED DESCRIPTION

Figure 1:
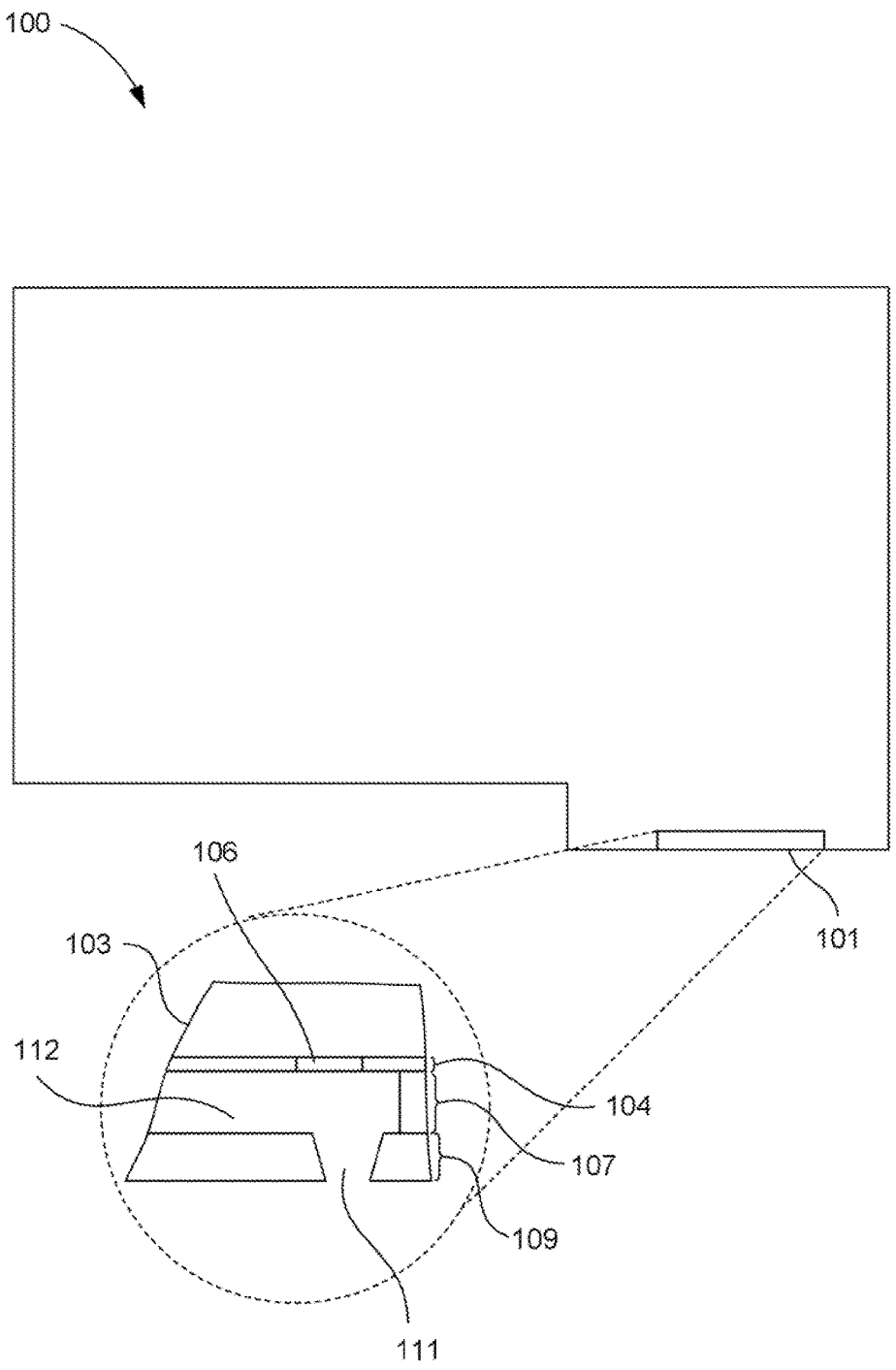
FIG. 1 is a diagram of a printhead that uses a fluidic ejection device with layers having different light sensitivities according to one example of the principles described herein.

Printers are used to deposit ink on a print medium. Accordingly, a printer may include a printhead that includes an ink reservoir fluidly connected to a firing chamber and nozzle. The firing chamber and nozzle may be used to eject ink from the printhead onto the print medium. The firing chamber and nozzle may be microfluidic devices that are formed in a number of ways. For example, in one operation, the enclosed firing chamber and nozzle may be formed using a metal orifice plate (MOP) attach process by which a metal electroplated sheet, having a number of openings that define the nozzles, is attached to a photo-patterned polymer structure on a thin-film electronic circuit.

While this MOP process may be low cost and simple, it may suffer from performance inefficiencies. For example, during the attachment process, the openings on the electroplated metal sheet may align poorly with other components on the thin-film electronic circuit, such as a resistor used to eject ink from the nozzle. Such poor alignment may affect printer performance by negatively affecting the drop trajectory of the ink to be deposited. The MOP process also suffers from limitations regarding available space and the number and size of nozzles that can be formed on a printhead. Accordingly, a fully integrated process may improve some aspects of firing chamber and nozzle performance. In a fully integrated process, a chamber may be formed via complex photolithographic patterning of multiple layers of photo-imaging polymer material with an intermediary polymer fill and chemical mechanical polishing operation. However, while a fully integrated process may improve some aspects of printhead performance, some characteristics reduce its effective implementation.

For example, the fully integrated process involves the use of a sacrificial polymer that is chemically and mechanically polished. The use of a sacrificial polymer and the chemical mechanical process adds complexity and cost to ejection device formation which translates to an increased cost of an ejection device. This process also uses additional machining which may suggest additional equipment and a corresponding capital investment.

Accordingly, the systems and methods disclosed herein allow for a simple, cost-effective fluidic ejection device that improves performance of the firing chamber and nozzle. More specifically, the present disclosure describes a process that eliminates the chemical mechanical polishing stage and the wax fill from firing chamber and nozzle formation. This is achieved by using photoresist layers that have different sensitivities to exposing light. The multiple layers may include a first layer that includes a first photoresist that has a reduced level of photoactive component such that it is less sensitive to light energy as compared to a second photoresist. The multiple layers may also include a second layer of a second photoresist that is an active photoresist that does not have a reduced level of photoactive component such that it is more sensitive to light energy as compared to the first photoresist. The reduced level of photoactive components in the first photoresist may result in a photoresist that is less sensitive to light, and for which a higher energy level is used to cross-link the photoresist.

The present disclosure describes a method for forming a fluidic ejection device. The method includes depositing a first layer on a substrate. The first layer includes a first photoresist. The method also includes exposing, at a first energy level, a portion of the first photoresist. The method also includes depositing a second layer on the first layer. The second layer includes a second photoresist that is more sensitive to light than the first photoresist. The method further includes exposing, at a second energy level, a portion of the second photoresist, in which the second energy level is less than the first energy level. The method further includes developing unexposed portions of the first photoresist and the second photoresist to form an enclosed firing chamber and a nozzle.

The present disclosure describes a fluidic ejection device. The fluidic ejection device includes a substrate and multiple layers of photoresist disposed on top of the substrate. At least one layer of photoresist includes a void that defines an enclosed firing chamber and at least one layer of photoresist includes a void that defines a nozzle. The different layers of photoresist have differing sensitivities to light.

The present disclosure describes a fluidic ejection system. The system includes a printhead and a number of fluidic ejection devices integral to the printhead. Each fluidic ejection device includes a substrate, a first layer of a first photoresist, in which the first layer includes a void that defines an enclosed firing chamber, and a second layer of a second photoresist, in which the second photoresist includes a void that defines a nozzle. The second photoresist is more sensitive to light than the first photoresist.

As used in the present specification and in the appended claims, the term "energy level" may refer to an energy level used to expose a photoresist. An energy level may refer to an exposure density, an exposure time, a wavelength of ultraviolet light used to expose a photoresist, or combinations thereof. In some examples, the energy level used to expose a portion of a photoresist may be based, at least in part, on a sensitivity of the photoresist.

Further, as used in the present specification and in the appended claims, the term "sensitivity," "photosensitivity," or similar terminology may refer to the propensity of a photoresist to be exposed to light. Sensitivity may be defined by the amount of photoactive components found in the photoresist. For example, a photoresist that is more sensitive, has more photoactive components, and therefore may be exposed at a lower energy level. By comparison, a photoresist that is less sensitive, has less photoactive components, and therefore may be exposed at a higher energy level.

Still further, as used in the present specification and in the appended claims, the term "light" may refer to light particles that are used to expose a portion of the photoresist. In some examples, the light may include light beams in the ultraviolet range.

Still further, as used in the present specification and in the appended claims, the term "reduced level" may indicate that a particular photoresist has less photoactive components than another photoresist. A reduced level photoresist may be formed by mixing an inactive version of a photoresist with an active version of the photoresist. Accordingly, an "active" version of a photoresist may be a photoresist that includes photoactive components. By comparison, an "inactive" version of the photoresist may not include photoactive components.

Accordingly, a reduced level photoresist, as it is a combination of the active and inactive photoresists, may have a number of photoactive components between the active version and the inactive version. The number of photoactive components in the reduced level photoresist may be based on the ratio to which the inactive photoresist and the active photoresist are mixed.

Still further, as used in the present specification and in the appended claims, the term "a number of" or similar language may include any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Turning now to the figures, FIG. 1 is a diagram of a printhead (100) that uses a fluidic ejection device (101) having layers of different light sensitivities according to one example of the principles described herein. In some examples, the printhead (100) may carry out at least a part of the functionality of ejecting ink droplets on to a print medium. For example, the printhead (101) may include an ink reservoir that holds into be deposited on a print medium. The printhead (100) may eject drops of ink from the nozzles onto a print medium in accordance with a received print job. The printhead (100) may also include other circuitry to carry out various functions related to printing.

For simplicity, in FIG. 1, a number of components and circuitry included in the printhead (100) are not indicated; however such components may be present in the printhead (100). In some examples, the printhead (100) is removable from the printing system for example, as a disposable printer cartridge. In some examples, the printhead (100) is part of a larger system such as an integrated printhead (IPH). The printhead (100) may of varying types. For example, the printhead (100) may be a thermal inkjet (TIJ) printhead.

The printhead (100) may include a number of fluidic ejection device (101). The fluidic ejection devices (101) may be integrally formed with the printhead (100). A fluidic ejection device (101) may be any component, or combination of components used to eject ink from the printhead (100). For example, the fluidic ejection device (101) on a TIJ printhead may include a resistor (106), an enclosed firing chamber (112), and a nozzle (111) The nozzle (111) may be a component that includes a small opening through which ink is deposited onto the print medium. The enclosed firing chamber (112) may include a small amount of ink. The resistor (106) is a component that heats up in response to an applied voltage. As the resistor (106) heats up, a portion of the ink in the firing chamber (112) vaporizes to form a bubble. This bubble pushes liquid ink out the nozzle (111) and onto the print medium. As the vaporized ink bubble pops, a vacuum pressure within the firing chamber (112) draws ink into the firing chamber (112) from the ink reservoir, and the process repeats.

The fluidic ejection device (101) may include a number of layers (104, 107, 109) of photoresist that define the enclosed firing chamber (112) and the nozzle (111). The photoresist on the different layers (104, 107, 109) having different light sensitivities. For example, the fluidic ejection device (101) may include a device substrate (103), and a coating layer (104) that includes the resistor (106). The fluidic ejection device (101) also includes a first layer (607) that defines an enclosed firing chamber (112) and a second layer (609) that defines a nozzle (111). More detail regarding the different layers (104, 107. 109) and the formation of such is given below in connection with FIGS. 3-6.

A fluidic ejection device (101) being formed of layers (104, 107, 109) with different light sensitivities is beneficial in that it provides for a more simple and cheaper manufacturing process as it alleviates 1) the use of a sacrificial polymer layer and 2) a chemical mechanical polishing of said sacrificial polymer.

Figure 2:
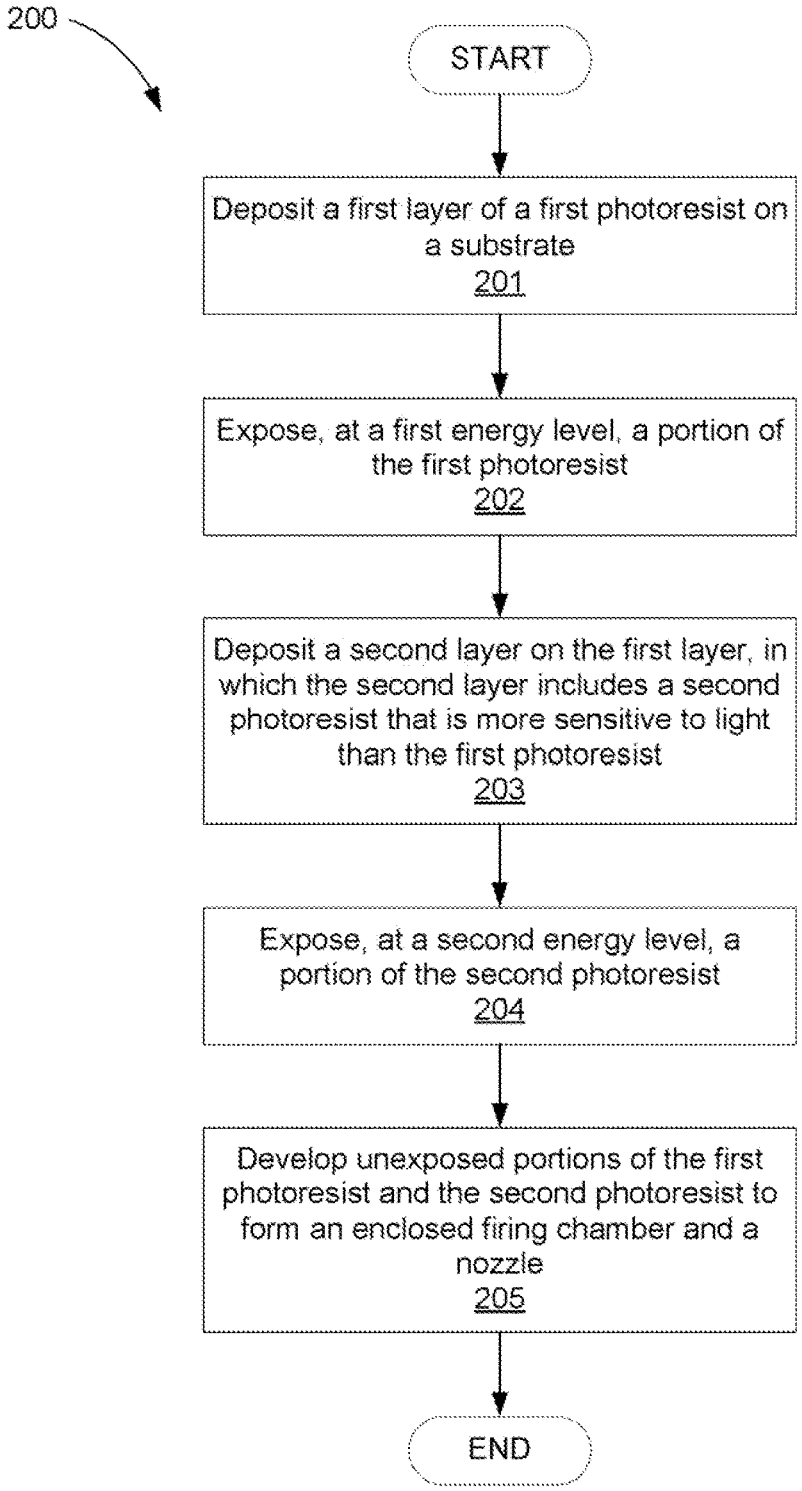
FIG. 2 is a flowchart of a method for forming a fluidic ejection device with layers having different light sensitivities according to one example of the principles described herein.

FIG. 2 is a flowchart of a method (200) for forming a fluidic ejection device (FIG. 1, 101) with layers (FIG. 1, 104, 107,109) having different light sensitivities according to one example of the principles described herein. The method (200) includes depositing (block 201) a first layer (FIG. 1, 107) on a substrate (FIG. 1, 103). The first layer (FIG. 1, 107) may include a first photoresist. A photoresist may refer to any light-sensitive material. For example, a photoresist may be an epoxy-based polymer. In some examples, the substrate (FIG. 1, 103) may be a silicon wafer. More specifically, the substrate (FIG. 1, 103) may be a coated silicon wafer. The coating of the silicon wafer will be described in more detail below with regards to FIGS. 3 and 8.

In some examples, the first photoresist may be a photoresist that is less sensitive to light as compared to the second photoresist described below. For example, the first photoresist may be a mixture of an active version of a particular photoresist with an inactive version of the particular photoresist. An active version of a photoresist indicates that the photoresist contains a certain amount of photoactive components. By comparison, an inactive version of a photoresist may indicate that the photoresist is free of photoactive components. Accordingly, as an active version of the photoresist and the inactive version of the photoresist are mixed, the photoactive components are diluted such that the first photoresist may have an amount of photoactive component less than the active photoresist and greater than the inactive photoresist.

The amount of photoactive component found in the first photoresist may be defined by the ratio of inactive photoresist to active photoresist used to form the first photoresist. For example, the first photoresist may include up to 95% by weight of the inactive photoresist and up to 5% by weight of the active photoresist. This combination may result in a first photoresist that is less sensitive to light than the active photoresist.

The method (200) may include exposing (block 202) at a first energy level, a portion of the first photoresist. In some examples, an unexposed portion of the first photoresist may include a void that defines an enclosed firing chamber (FIG. 1, 112). For example, a photo mask may be positioned over a portion of the first layer (FIG. 1, 107) that is to become the enclosed firing chamber (FIG. 1, 112). The first photoresist may then be exposed to a light source, such as an ultraviolet light, exposing portions of the first photoresist that are to remain. The portion of the first photoresist that is to become the enclosed firing chamber (FIG. 1, 112) remains unexposed on account of the photo mask. Then, as will be described in detail below, during developing, the unexposed portion that defines the enclosed firing chamber (FIG. 1, 112) may be removed to create a void that defines the enclosed firing chamber (FIG. 1, 112)

In some examples, the first energy level indicates an exposure density, exposure time, or combinations thereof, of a light beam used to expose portions of the first photoresist. For example, as described above, the first photoresist may include a reduced level of photoactive component such that a higher energy level is used to expose the first photoresist as compared to an active version of the photoresist. In some examples, the first energy level may be between 1500 microJoules (mJ) and 2000 mJ; however any range of energy levels may be used.

In some examples, the first energy level indicates a wavelength of the light that is used to expose the first photoresist. In some examples, the wavelength of light that is used to expose the first photoresist may be greater than the wavelength of light used to expose the second photoresist as will be described in detail below.

The method (200) includes depositing (block 203) a second layer (FIG. 1, 109) on the first layer (FIG. 1, 107). The second layer (FIG. 1, 109) may include a second photoresist that is more sensitive to light as compared to the first photoresist. For example, as described above, the first photoresist may include a mixture of an active version of a photoresist material and an inactive version of the photoresist material. Accordingly, the first photoresist may have a reduced level of photoactive component. In some examples, the second photoresist may be an active version of a photoresist, such that it does not have a reduced level of photoactive component. The increased amount of photoactive component in the second photoresist may indicate that the second photoresist is more sensitive to light than the first photoresist. Specifically, the second photoresist may be at least eight times more sensitive to light than the first photoresist. Put another way, the first photoresist may be at least eight times less sensitive to light than the second photoresist.

The method (200) may include exposing (block 204) at a second energy level, a portion of the second photoresist. In some examples, an unexposed portion of the second photoresist may include a void that defines a nozzle (FIG. 1, 111). For example, a photo mask may be positioned over a portion of the second layer (FIG. 1, 109) of second photoresist that is to become the nozzle (FIG. 1, 111). The second photoresist may then be exposed to a light source, such as an ultraviolet light source, exposing portions of the second photoresist that are to remain. The portion of the second photoresist that is to become the nozzle (FIG. 1, 111) remains unexposed on account of the photo mask. Then, as will be described in detail below, during developing, the unexposed portion that defines the nozzle (FIG. 1, 111) may be removed to create a void that defines the nozzle (FIG. 1, 111).

In some examples, the second energy level indicates an exposure density, exposure time, or combinations thereof, of a light beam used to expose portions of the second photoresist. For example, as described above, the second photoresist may not include a reduced level of photoactive component such that a lower energy level may be used to expose the second photoresist as compared to a the first photoresist. Specifically, the second energy level used to expose portions of the second photoresist may be at least eight times less than the first energy level used to expose portions of the first photoresist. In other words, the first energy level may be at least eight times greater than the second energy level, Using photoresists of differing sensitivities may be beneficial in that exposing the second photoresist at a second energy level that is less than the first energy level avoids exposing the first photoresist a second time. In other words, the second exposure (block 204) does not further expose the first layer (FIG. 1, 107) of the first photoresist. In some examples, the second energy level may be between 150 mJ and 200 mJ, however any range of energy levels may be used.

In some examples, the second energy level indicates a wavelength of the light that is used to expose the second photoresist. In some examples, the wavelength of light that is used to expose the second photoresist may be shorter than the wavelength of light used to expose the first photoresist such that a light that exposes the second photoresist does not expose the first photoresist.

The method (200) may include developing (block 205) unexposed portions of the first photoresist and the second photoresist to form an enclosed firing chamber (FIG. 1, 112) and a nozzle (FIG. 1, 111), respectively. More specifically, as described above, an unexposed portion of the first photoresist may define an enclosed firing chamber (FIG. 1, 112) and an unexposed portion of the second photoresist may define a nozzle (FIG. 1, 111). In developing (block 205) unexposed portions of the photoresists, the unexposed material is dissolved and carried away such that voids are left in the first photoresist and second photoresist. In some examples, the developer may include, but is not limited to, ethyl lactate, propylene glycol monomethyl ether acetate (PGMEA), or combinations thereof. The developer may dissolve the unexposed photoresist allowing it to be removed from the first layer (FIG. 1, 107) and the second layer (FIG. 1 109).

The method (200) described herein may be beneficial in that it is a low-cost and simple process that maintains printhead (100) performance. For example, the method (200) described herein may alleviate the use of a sacrificial polymer, such as a wax fill, to define the enclosed firing chamber (FIG. 1, 112) and nozzle (FIG. 1, 111). Still further, the present method (200) may alleviate the need to perform a chemical mechanical polishing of the sacrificial polymer.

An additional benefit is that the method (200) incorporates a reduced number of developer stages. For example, rather than having developer stages that accompany each exposure stage, a single developer stage may be implemented after multiple exposure stages. Thus, the method (200) as described herein eliminates a number of complex operations which may reduce cost and capital investment to manufacture. The present method (200) also maintains performance by properly aligning a resistor (FIG. 1 106), an enclosed firing chamber (FIG. 1, 112) and a nozzle (FIG. 1, 111).

Figure 3:
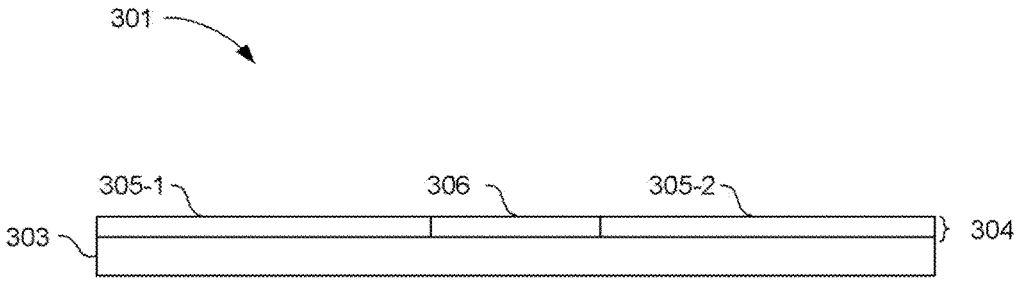
FIG. 3 is a diagram illustrating the formation of a fluidic ejection device with layers having different light sensitivities according to one example of the principles described herein.

FIG. 3 is a diagram illustrating the formation of a fluidic ejection device (301) with layers (304) of different light sensitivities according to one example of the principles described herein. The fluidic ejection device (301) may include a device substrate (303). For example, the device substrate (303) may be a silicon wafer. In some examples, the device substrate (303) may be any material that provides for electrical, mechanical, or combinations thereof, support for the fluidic ejection device (301). Via the device substrate (303), the fluidic ejection device (301) is coupled to a printhead (FIG. 1, 100). More specifically, the device substrate (303) provides for a mechanical attachment of the fluidic ejection device (301) with components of the printhead (FIG. 1 100) such as the ink reservoir and other circuitry used to carry out the functionality of depositing ink on a printed medium. The device substrate (303) may also provide for electrical communication between the circuitry of the printhead (FIG. 1, 100) and the fluidic ejection device (301) to carry out the functionality of depositing ink on a print medium.

In some examples, the substrate (303) may include a coating layer (304). The coating layer (304) may include a number of components that allow the fluidic ejection device (301) to carry out at least a portion of ink ejection. For example, the coating layer (304) may include a resistor (306). The resistor (306) is an element that heats up in response to an electrical current. The resistor (306), upon heating, vaporizes a small amount of ink that is deposited in the enclosed firing chamber (FIG. 1, 112). The generated vapor bubble may force liquid ink out of the enclosed firing chamber (FIG. 1, 112) through the nozzle (FIG. 1, 111), to be ultimately deposited on the print medium. The coating layer (304) may also include sections (305-1, 305-2) of a third photoresist on either side of the resistor (306). The third photoresist sections (305-1, 305-2) may serve as a protectant of the resistor (306) and may also provide a flat surface on which the first layer (FIG. 1, 107) of the first photoresist may be deposited. In some examples, the coating layer (304) may be photo-patterned to include a number of channels and conduits to carry out different functions related to fluidic ejection.

As will be described in more detail below, in some examples, the third photoresist may be less sensitive to light than the first photoresist, such that the third photoresist is exposed at an energy level that is greater than the first energy level. Providing a third photoresist that is less sensitive to light than the first photoresist may be beneficial in that any subsequent exposure of the first photoresist at the first energy level does not expose any portion of the third photoresist.

In another example, the third photoresist may share sensitivity characteristics with the second photoresist, such that a similar energy level is used to expose the third photoresist as the second photoresist. Incorporation of a third photoresist in the coating layer (304) may be beneficial in that it allows for further customization of the fluidic ejection device (301) without requiring additional complex manufacturing processes or additional developing stages. In some examples, the coating layer (304) may be a thin-film layer. For example, the coating layer (304) may be approximately 2 micrometers thick.

Figure 4:
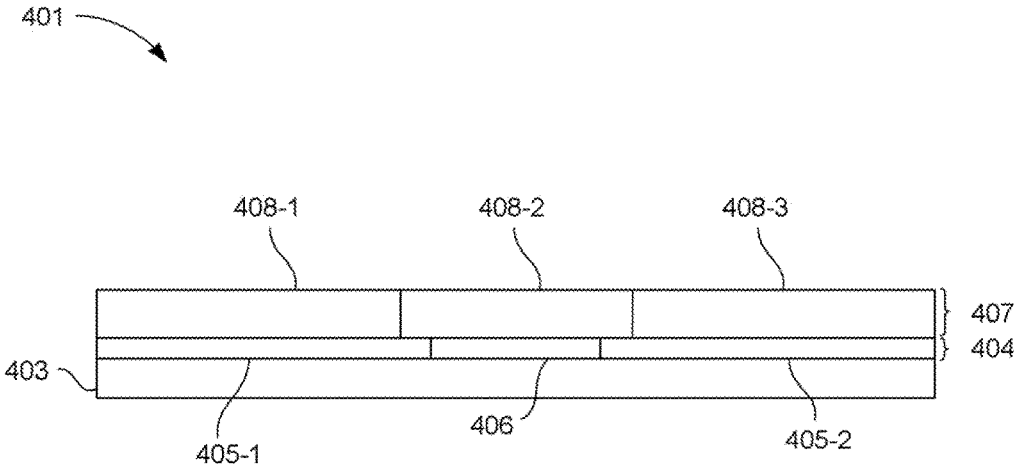
FIG. 4 is another diagram illustrating the formation of a fluidic ejection device with layers having different light sensitivities according to one example of the principles described herein.

FIG. 4 is another diagram illustrating the formation of a fluidic ejection device (401) with layers (404, 407) having different light sensitivities according to one example of the principles described herein. The fluidic ejection device (401) may include a device substrate (403), a coating layer (404) made up of sections (405-1, 405-2) of a third photoresist and a resistor (406) similar to corresponding elements described in connection with FIG. 3, The fluidic ejection device (401) also includes a first layer (407) that defines an enclosed firing chamber (FIG. 1, 112). The first layer (407) may include a number of sections (408) of a first photoresist. The first photoresist may be a version of the photoresist that has a reduced level of photoactive components such that is less sensitive to light as compared to the second photoresist. The first photoresist may also be exposed by a light having a higher energy level as compared to a light used to expose the second photoresist. More specifically, the first photoresist may be at least 8 times less sensitive to light than the second photoresist and may be exposed to a light that is at least 8 times stronger than the light used to expose the second photoresist.

The first layer (407) may include a number of sections (408) that may define an enclosed firing chamber (FIG. 1, 112). More specifically, a first layer central section (408-2) may indicate a portion of the first layer (407) that will be unexposed. The first layer central section (408-2) may remain unexposed by placing a photo mask on top of the first layer central section (408-2), then exposing the first layer (407). By comparison, a number of first layer side sections (408-1, 408-3) may be exposed. Then, during developing, the first layer side sections (408-1. 408-3), on account of being exposed, may remain, while the first layer central section (408-2), on account of being unexposed, may be dissolved and carried away by a developer. The void generated by the carried away unexposed central section (408-2) may define the enclosed firing chamber (FIG. 1, 112).

Figure 5:
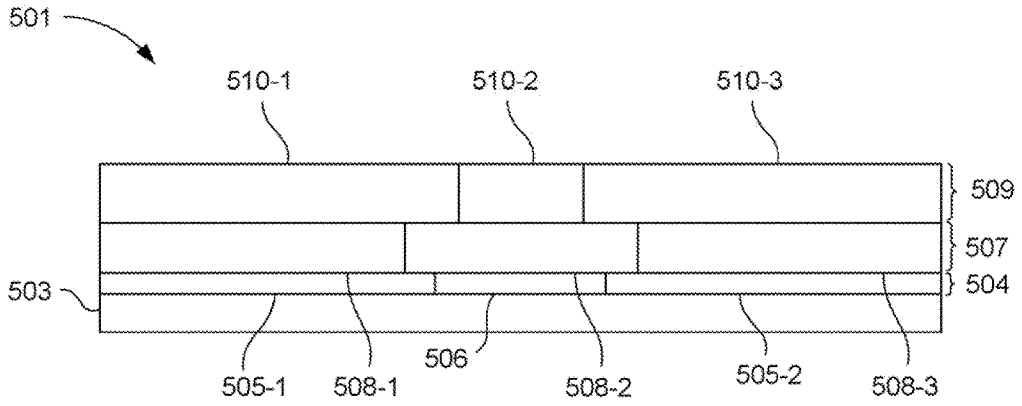
FIG. 5 is another diagram illustrating the formation of a fluidic ejection device with layers having different light sensitivities according to one example of the principles described herein.

FIG. 5 is another diagram illustrating the formation of a fluidic ejection device (501) with layers (504, 507, 509) having different light sensitivities according to one example of the principles described herein. The fluidic ejection device (501) may include a device substrate (503), a coating layer (504) made up of sections (505-1, 505-2) of a third photoresist and a resistor (506), and a first layer (507) made up of sections (508-1, 508-2, 508-3) of a first photoresist to corresponding elements described in connection with FIGS. 3 and 4.

The fluidic ejection device (501) may also include a second layer (509) that may define a nozzle (FIG. 1, 111). More specifically, the second layer (509) may include a number of sections (510) of a second photoresist. The second photoresist may be a version of the photoresist that is active. In other words, the second photoresist may not have a reduced level of photoactive component and may be more sensitive to light as compared to the first photoresist of the first layer (507). Accordingly, the second photoresist of the second layer (509) is exposed by a light having a lower energy level as compared to a light used to expose the first layer (507) as described above. More specifically, the second photoresist may be at least eight times more sensitive to light than the first photoresist and may be exposed to a light that is at least 8 times weaker than the light used to expose the first photoresist.

The second layer (509) may include a number of sections (510) that may define a nozzle (FIG. 1, 111). More specifically, a second layer central section (510-2) may indicate a portion of the second layer (509) that will be unexposed. The second layer central section (510-2) may remain unexposed by placing a photo mask on top of the second layer central section (510-2). By comparison, a number of second layer side sections (510-1, 510-3) may be exposed. Then during developing, the second layer side sections (510-1, 510-3), on account of being exposed, may remain, while the second layer central section (510-2), on account of being unexposed, may be dissolved and carried away by a developer. The void generated by the carried away unexposed central section (510-2) may define the nozzle (FIG. 1, 111).

Figure 6:
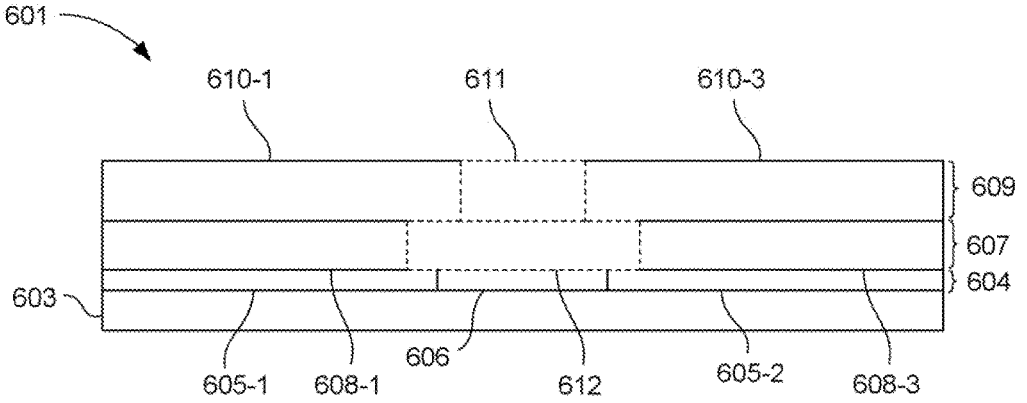
FIG. 6 is another diagram illustrating the formation of a fluidic ejection device with layers having different light sensitivities according to one example of the principles described herein.

FIG. 6 is another diagram illustrating the formation of a fluidic ejection device (601) with layers (604, 607. 609) having different light sensitivities according to one example of the principles described herein. The fluidic ejection device (601) includes a device substrate (603), a coating layer (604) made up of sections (605-1, 605-2) of a third photoresist and a resistor (606), a first layer (607) made up of sections (608-1, 608-3) of a first photoresist, and a second layer (609) made up of sections (610-1, 610-3) of a second photoresist similar to corresponding elements described in connection with FIGS. 3-5.

As described above, a developer may be used to dissolve and remove unexposed portions of the first layer (607) and the second layer (609). For example, as described above, the first layer (607) may include a central section (FIG. 4, 408-2) that may be left unexposed and that may define an enclosed firing chamber (612). Accordingly, the developer, by removing the unexposed photoresist from the first layer central section (FIG. 4, 408-2), may generate a void that defines an enclosed firing chamber (612).

Similarly, as described above, the second layer (609) may include a second layer central section (FIG. 5, 510-2) that may be left unexposed and that may define a nozzle (611). Accordingly, the developer, by removing the unexposed photoresist from the second layer central section (FIG. 5, 510-2), may generate a void that defines a nozzle (611).

The method as described in FIGS. 2-6 may be beneficial in that it relies on different layers (604, 607, 609) having different light sensitivities to define the voids that will form the enclosed firing chamber (612) and the nozzle (611). Doing so eliminates the use of any sacrificial polymer and also alleviates the need for certain operations that may otherwise prove complex and costly. While FIGS. 3-6 depict three layers (604, 607, 609) any number of layers may be used to generate the fluidic ejection device (601) with at least one layer including a void that defines an enclosed firing chamber (612) and at least one layer including a void that defines a nozzle (611).

Figure 7:
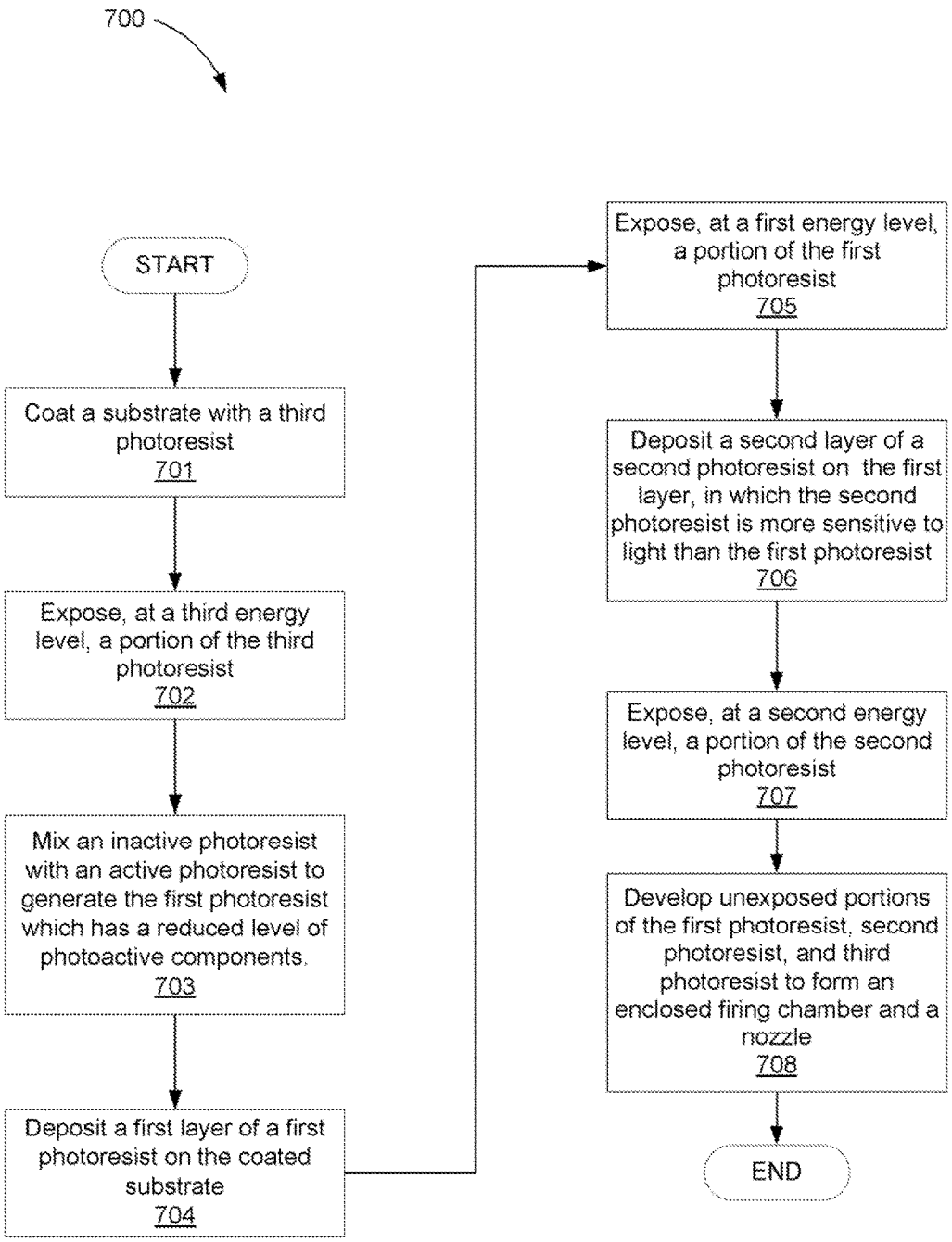
FIG. 7 is another flowchart of a method for forming a fluidic ejection device with layers having different light sensitivities according to one example of the principles described herein.

FIG. 7 is another flowchart of a method (700) for forming a fluidic ejection device (FIG. 1, 101) with layers (FIG. 6, 604, 607, 609) having different light sensitivities according to one example of the principles described herein. The method (700) may include coating (block 701) a substrate (FIG. 1, 103) with a third photoresist. As demonstrated above, the fluidic ejection device (FIG. 1, 101) may include a device substrate (FIG. 1, 103). For example, the device substrate (FIG. 1, 103) may be a silicon wafer or any material that provides electrical, mechanical, or combinations thereof, support for the fluidic ejection device (FIG. 1, 101). In some examples, the device substrate (FIG. 1, 103) may be coated (block 701) with a third photoresist.

In some examples, the third photoresist may be a photoresist that is less sensitive to light as compared to the first photoresist of the first layer (FIG. 1, 107). For example, as described above, the first photoresist of the first layer (FIG. 1, 107) may include a mixture of an active version of a photoresist material and an inactive version of the photoresist material. Accordingly, the first photoresist may have a reduced level of photoactive component. In some examples, the third photoresist of the coating layer (FIG. 1, 104) may be a different mixture of an inactive version of the photoresist and an active version of the photoresist such that the third photoresist contains less photoactive components as compared to the first photoresist. In other words, the third photoresist of the coating layer (FIG. 1, 104) may be less sensitive to light than the first photoresist of the first layer (FIG. 1, 107).

Providing a third photoresist that is less sensitive to light than the first photoresist may be beneficial in that any subsequent exposure of the first photoresist at the first energy level does not expose any portion of the third photoresist. In this example, the first photoresist may be less sensitive to light than the second photoresist, and the third photoresist may be less sensitive to light than the first photoresist.

In some examples, the third photoresist of the coating layer (FIG. 1, 104) may be share sensitivity characteristics with the second photoresist such that a similar energy level may be used to expose the third photoresist and the second photoresist. In other words, the third energy level used to expose the third photoresist may be the same as the second energy level used to expose the second photoresist. In other words, the third energy level may be at least eight times weaker than the first energy level. In this example, the first photoresist may be less sensitive to light than the second photoresist and the third photoresist. In some examples, the third photoresist may be photo-patterned to include a number of channels and conduits to carry out different functions related to fluidic ejection.

Incorporation of a third photoresist in the coating layer (FIG. 1, 104) may be beneficial in that it allows for further customization of the fluidic ejection device (FIG. 1, 101) without requiring additional complex manufacturing processes or additional developing stages.

The method (700) may include exposing (block 702) at a third energy level, a portion of the third photoresist. In some examples, the third energy level may be greater than the first energy level. More specifically, the third energy level may be at least eight times greater than the first energy level. For example, as described above, the second photoresist may include a reduced level of photoactive component such that a lower energy level may be used to expose the second photoresist as compared to a the first photoresist. Similarly, the third photoresist may include a further reduced level of photoactive component such that a higher energy level may be used to expose the third photoresist as compared to the second photoresist. Using photoresists of differing sensitivities may be beneficial in that exposing the third photoresist at a third energy level that is greater than the first energy level avoids exposing the third photoresist a second time. In other words, any subsequent exposure may not further expose he third photoresist of the coating layer (FIG. 1, 104), In some examples, the third energy level may indicate a wavelength of the light that is used to expose the third photoresist. In some examples, the wavelength of light that is used to expose the third photoresist may be longer than the wavelength of light used to expose the first photoresist such that a light that exposes the first photoresist does not expose the third photoresist.

The method (700) may include mixing (block 703) an inactive version of the photoresist with an active version of the photoresist to generate the first photoresist which has a reduced level of photoactive component. As described above, the first photoresist may include a reduced number of photoactive components. The first photoresist with the reduced number may be generated by mixing an inactive version of a photoresist with an active version of the photoresist. For example, the inactive version of a photoresist, which does not contain photoactive components, may be mixed with an active version of the photoresist, which may contain photoactive components, at a ratio of up to 9.5:0.5. While specific reference is made to a ratio of 9.5:0.5, the first photoresist may be formed using any ratio.

The method (700) may include depositing (block 704) a first layer (FIG. 1, 107) on the coated substrate (FIG. 1, 103). The first layer (FIG. 1, 107) may include a first photoresist. This may be performed as described in connection with FIG. 2.

The method (700) may include exposing (block 705), at a first energy level, a portion of the first photoresist. This may be performed as described in connection with FIG. 2.

The method (700) may include depositing (block 706) a second layer (FIG. 1, 109) on the first layer (FIG. 1, 107). The second layer (FIG. 1, 109) may include a second photoresist that is more sensitive to light as compared to the first photoresist. This may be performed as described in connection with FIG. 2.

The method (700) may include exposing (block 707), at a second energy level, a portion of the second photoresist. This may be performed as described in connection with FIG. 2.

The method (700) may include developing (block 708) unexposed portions of the first photoresist, the second photoresist, and the third photoresist to form an enclosed firing chamber (FIG. 1, 112) and a nozzle (FIG. 1, 111). This may be performed as described in connection with FIG. 2.

A device and method for forming a fluidic ejection device with layers having different light sensitivities may have a number of advantages, including: (1) reducing cost associated with printhead manufacturing; (2) reducing capital investment to produce printheads; (3) reducing complexity of printhead manufacture; and (5) maintaining printing performance.

The preceding description has been presented to illustrate and describe examples of the principles described. This description is not intended to be exhaustive or to limit these principles to any precise form disclosed. Many modifications and variations are possible in light of the above teaching,

What is claimed is:

1. A fluidic ejection device, the device comprising:
- a substrate;
- multiple layers of photoresist disposed on the substrate, in which:
  - at least one layer of photoresist includes a void that defines an enclosed firing chamber;
  - at least one layer of photoresist includes a void that defines a nozzle; and
  - the different layers of photoresist have differing sensitivities to light.

2. A method for forming the fluidic ejection device of claim 1, the method comprising:
- depositing a first layer on the substrate, in which the first layer comprises a first photoresist;
- exposing, at a first energy level, a portion of the first photoresist;
- depositing a second layer on the first layer, in which the second layer comprises a second photoresist that is more sensitive to light than the first photoresist;
- exposing, at a second energy level, a portion of the second photoresist, in which the second energy level is less than the first energy level; and
- developing unexposed portions of the first photoresist and the second photoresist to form the enclosed firing chamber and the nozzle.

3. The method of claim 2, in which the first energy level, the second energy level, or combinations thereof indicate an exposure density, exposure time, or combinations thereof, of a light beam used to expose portions of the photoresists.

4. The method of claim 2, in which the first energy level is at lea eight times greater than the second energy level.

5. The method of claim 2, further comprising:
- coating a silicon wafer with a third photoresist to form the substrate; and
- exposing a portion of the third photoresist at a third energy level.

6. The method of claim 5, in which the third photoresist is less sensitive to light than the first photoresist.

7. The method of claim 5, in which the third photoresist is the same as the second photoresist.

8. The method of claim 2, in which the first energy level, the second energy level, or combinations thereof indicate a wavelength of a light beam used to expose portions of the photoresists.

9. The method of claim 8, in which the first energy level indicates a beam wavelength that is greater than a beam wavelength indicated by the second energy level.

10. The method of claim 2, further comprising mixing an inactive photoresist with an active photoresist to generate the first photoresist which first photoresist has a reduced level of photoactive component.

11. The device of claim 1, in which a first photoresist has less photoactive component than a second photoresist.

12. The device of claim 11, in which:
- the first photoresist comprises a mixture of up to 95% inactive photoresist with as little as 5% active photoresist; and
- the second photoresist comprises the active photoresist.

13. A fluidic ejection system, the system comprising:
- a printhead; and
- a number of fluidic ejection devices integral to the printhead, in which each fluidic ejection device comprises:
  - a substrate;
  - a first layer of a first photoresist on top of the substrate, in which the first layer includes a void that defines an enclosed firing chamber; and
  - a second layer of a second photoresist on top of the first layer, in which the second photoresist includes a void that defines a nozzle;
  - in which the second photoresist is more sensitive to light than the first photoresist.

14. The system of claim 13, in which the second photoresist is exposed at an energy level that does not expose the first photoresist.

15. The system of claim 14, in which the first photoresist is at least eight times less sensitive to light than the second photoresist.

* * * * *